US010486222B2

(12) United States Patent
Maggiolo et al.

(10) Patent No.: US 10,486,222 B2
(45) Date of Patent: Nov. 26, 2019

(54) HORIZONTAL EXPANDING MACHINE

(71) Applicant: CMS COSTRUZIONE MACCHINE SPECIALI S.R.L., Alonte (Vicenza) (IT)

(72) Inventors: Vinicio Maggiolo, Alonte (IT); Augusto Tovo, Alonte (IT)

(73) Assignee: CMS COSTRUZIONE MACCHINE SPECIALI S.R.L., Alonte (Vicenza) (IT)

( * ) Notice: Subject to any disclaimer, the term of this patent is extended or adjusted under 35 U.S.C. 154(b) by 230 days.

(21) Appl. No.: 15/538,010

(22) PCT Filed: Nov. 18, 2015

(86) PCT No.: PCT/IB2015/058923
§ 371 (c)(1),
(2) Date: Jun. 20, 2017

(87) PCT Pub. No.: WO2016/103076
PCT Pub. Date: Jun. 30, 2016

(65) Prior Publication Data

US 2017/0348758 A1 Dec. 7, 2017

(30) Foreign Application Priority Data

Dec. 23, 2014 (IT) ..... VR2014A0314

(51) Int. Cl.
*B21D 39/10* (2006.01)
*B21D 39/06* (2006.01)
*B21D 53/08* (2006.01)

(52) U.S. Cl.
CPC ..... *B21D 53/08* (2013.01); *B21D 39/06* (2013.01); *B21D 39/10* (2013.01)

(58) Field of Classification Search
CPC ..... B21D 53/08; B21D 39/06; B21D 39/08; B21D 39/10; B21D 39/12; B21D 39/14; B21D 39/18; B21D 39/20; Y10T 29/5199
See application file for complete search history.

(56) References Cited

U.S. PATENT DOCUMENTS 3,487,523 A * 1/1970 Ames ..... B21D 53/02 29/523
5,127,155 A 7/1992 Kendic
(Continued)

FOREIGN PATENT DOCUMENTS

EP 1213067 6/2002
JP S59110438 6/1984

OTHER PUBLICATIONS

International Search Report dated Mar. 17, 2016 for PCT/IB2015/058923 (2 pages).

*Primary Examiner* — Rick K Chang
(74) *Attorney, Agent, or Firm* — Tutunjian & Bitetto, P.C.

(57) ABSTRACT

A horizontal expanding machine, including a support frame defining a horizontal expanding axis (A), at least one guide associated with said frame and parallel to said expanding axis (A), at least one carriage moveable along said guide, a plurality of expanding shafts able to be associated with said carriage and arranged along said expanding axis (A). The machine includes automatic selection means of the expanding shafts adapted for selectively positioning said shafts on said carriage.

13 Claims, 9 Drawing Sheets

(56) References Cited

U.S. PATENT DOCUMENTS 5,265,129 A * 11/1993 Brooks ..... G21C 17/017
376/245
5,321,887 A * 6/1994 Boula ..... F22B 37/003
29/407.05
5,410,800 A * 5/1995 Gray ..... B21D 39/20
29/727

* cited by examiner

HORIZONTAL EXPANDING MACHINE

TECHNICAL FIELD OF THE INVENTION

The present invention concerns a horizontal expanding machine.

STATE OF THE ART

In the field of the production of heat exchangers, but also in other industrial sectors, expanding machines are used that carry out the expansion of metallic tubes for connection to the respective finned packs; the term expansion is generically meant to indicate the deformation process of the tubes themselves—in particular the radial expansion process—aimed at increasing their diameter to connect them permanently to the respective holes foreseen in the heat exchange fins.

Some particular types of expanding machines are of the so-called horizontal type, i.e. they comprise a mobile carriage carrying shafts that, by sliding along a machine axis that, indeed, is arranged horizontally, completely pass through the tubes to be expanded for their entire length in the same pass: the tubes are widened to the desired diameter through the action of respective mandrels associated with the ends of the shafts themselves.

In greater detail, the horizontal expansion operation can then be carried out by pulling or pushing.

In the first case, the shafts are provided with respective expansion mandrels, and are first inserted completely along the respective tubes with the mandrels in inactive position; after that, the mandrels are expanded and the shafts are pulled back by the carriage, so as to widen the tubes to the desired diameter. In the second case, the widening is, on the other hand, carried out directly in the insertion pass of the shafts in the respective tubes.

The operating conditions of course vary from case to case, for example because the expansion shafts must be suitably designed and sized to operate with opposite stresses.

Currently, in all fields of production, thus including that of heat exchangers, there is a great need for ever increasing flexibility of production, which allows the potential of the machines involved to be fully exploited.

In this specific case, horizontal expanding machines are normally characterised by high execution speed, even in the case of tubes of many metres in length.

Since such machines comprise many expanding shafts that operate in parallel, the execution times of the expansion process depend essentially on the length of the tubes of the single product being machined and on the number of tubes to be expanded.

It should also be considered that the products being machined, i.e. the various assembled parts comprising the tubes and the finned pack that will then constitute the finished exchangers, are obviously each characterised by different dimensions and geometries.

For example, each exchanger comprises its own number of tubes having a certain length, and the tubes are arranged—observing the exchanger from the front—on rows and columns distributed in a specific manner for that type of product; moreover, the tubes are positioned according to particular configurations and with distances between centres that obviously vary from one product to the next, and that can also be different within the same product.

Of course, as a result the expanding machine must be suitably re-equipped each time the product changes, or in other words each change of product must be accompanied by a respective change in format of the machine.

In particular, for every product the shafts that must be actively involved in the expansion process of that specific product must be associated with the carriage, whereas the other shafts must obviously be removed so as not to interfere with the production operations.

Currently, the change-of-format operations on horizontal expanding machines are carried out completely manually.

In greater detail, at least one skilled operator verifies that the expanding shafts to be used in a given job are actually connected to the carriage, whereas he/she takes care of withdrawing the unnecessary shafts from the carriage, then placing them, again manually, in a suitable store provided on the same machine.

Of course, these operations take time that, even in the case in which the operator is highly skilled and very fast, is certainly too long if compared with the actual execution times of the expanding machine.

Indeed, it is possible to end up with the paradoxical situation of taking tens of minutes, or even more, to equip a machine that will then complete the actual expansion operation in a couple of minutes.

This situation can in fact become unacceptable in the case in which the expanding machine is used to machine a few pieces of products that are very different from each other; in a case like this, the inactive times are certainly longer than the operative times, with substantial losses for the producer.

This problem is even more evident if one considers that the machine, as a result of its constructive and functional characteristics, could potentially even allow machining of many different products in parallel, with very low execution times.

SUMMARY OF THE INVENTION

The technical task of the present invention is to improve the state of the art.

Within such a technical task, a purpose of the present invention is to devise a horizontal expanding machine that allows the aforementioned drawbacks to be avoided.

Another purpose of the present invention is to make a horizontal expanding machine characterised by equipping and/or change-of-format times that are substantially shorter with respect to conventional machines.

A further purpose of the present invention is to devise a horizontal expanding machine capable of combining the advantages connected to its intrinsic high production speed with requirements of high flexibility, to effectively and quickly machine even a few pieces of products that are different from each other.

This task and these purposes are accomplished by the horizontal expanding machine according to the present application.

The horizontal expanding machine comprises a support frame defining a horizontal expanding axis, at least one guide associated with the frame and parallel to the expanding axis, at least a carriage moveable along the guide, and a plurality of expanding shafts, able to be associated with the carriage and arranged along the expanding axis itself.

According to the invention, the expanding machine comprises automatic selection means of the expanding shafts adapted for selectively constraining/releasing the shafts to/from the carriage.

Thanks to this solution, the shafts associated with the carriage not involved in a given expansion process are automatically excluded and taken away from the carriage itself through automated means suitably provided on the machine itself, without the need for long and expensive manual interventions.

The present application refers to preferred and advantageous embodiments of the invention.

BRIEF DESCRIPTION OF THE DRAWINGS

The features of the invention will become clearer to those skilled in the art from the following description and from the attached tables of drawings, given as a non-limiting example, in which.

DETAILED DESCRIPTION OF EMBODIMENTS OF THE INVENTION

Figure 1:
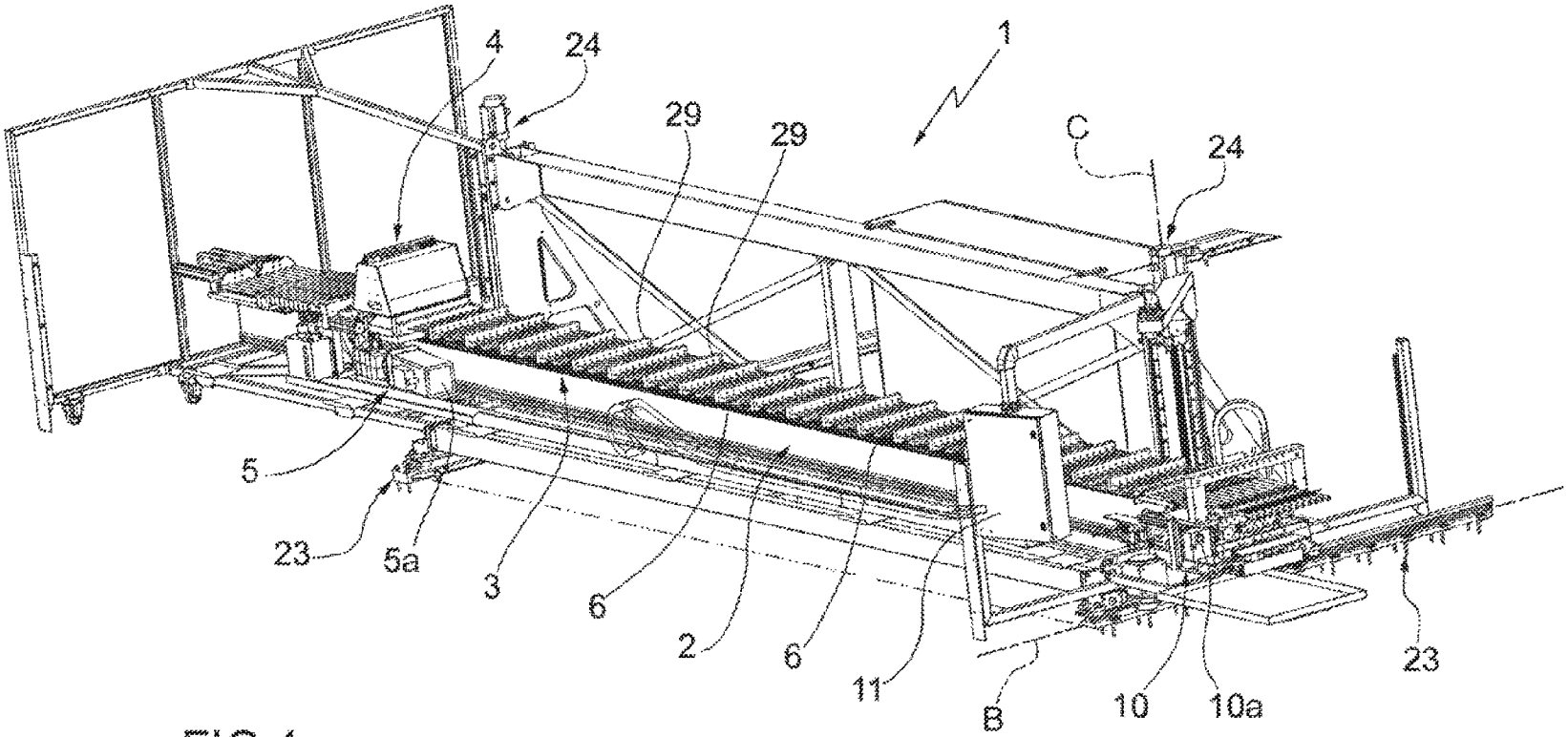
FIG. 1 is a perspective view of the expanding machine according to the invention.

With reference to the attached FIG. 1, a horizontal expanding machine according to the present invention is wholly indicated with 1.

The machine according to the present invention is suitable for carrying out the expansion of tubes belonging, for example, to heat exchangers or other similar elements, of whatever shape and size and comprising any number of tubes, however arranged, without any limitation.

The machine can, however, also be suitable for other applications in which it is necessary, for whatever reason, to enlarge the diameter of tubes or groups of tubes.

The machine 1 can potentially be used for expansion operations of tubes both by pulling and by pushing.

It should be specified that the specific embodiment of the machine 1, described hereinafter, and illustrated in FIGS. 1-16, is in particular of the type adapted for expansion by pulling: however, this is an example of application that does not per se constitute a limitation to the purposes of the present invention, as will become clearer hereinafter.

The machine 1 comprises a support frame 2.

Figure 5:
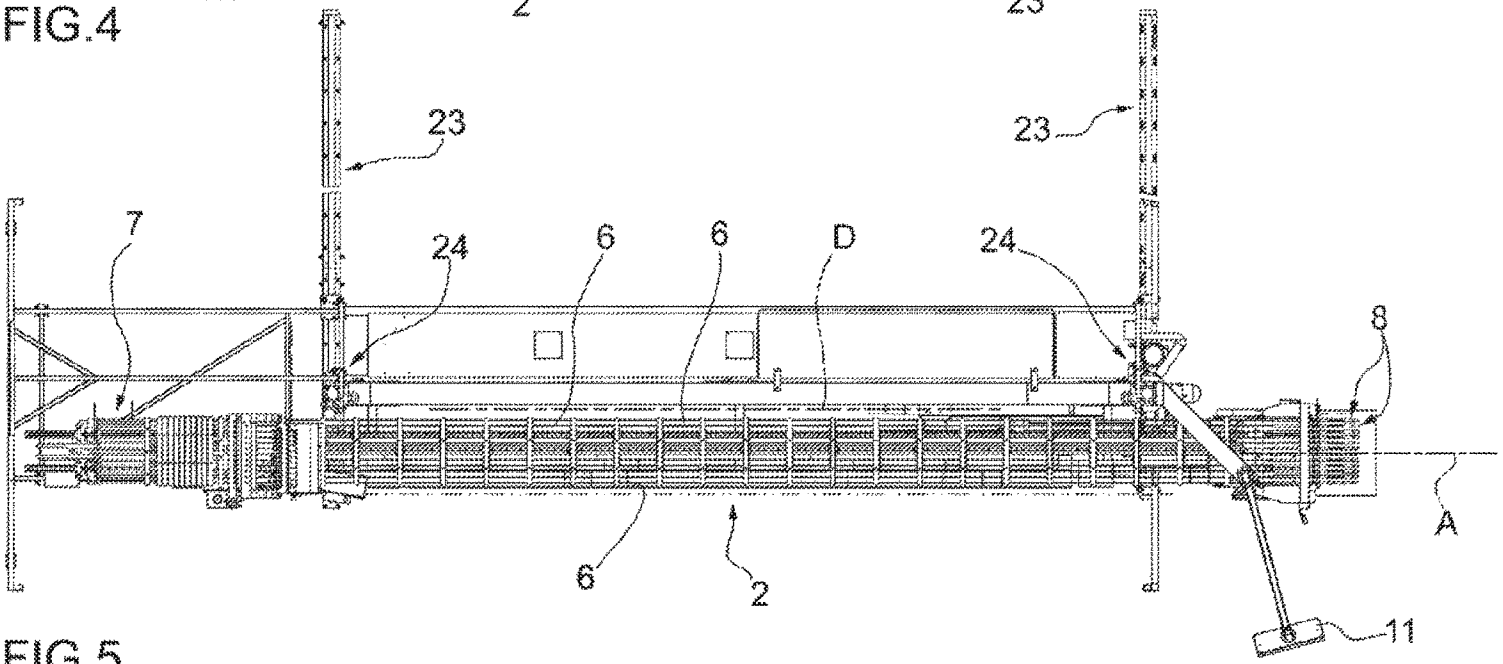
FIG. 5 is a plan view of the machine.

The support frame 2 defines a horizontal expanding axis A, schematically indicated in FIG. 5.

The machine 1 also comprises at least one guide 3.

The guide 3 is associated with the frame 2, and is parallel to the expanding axis A.

The machine 1 comprises at least one carriage 4, moveable along the guide 3.

The carriage 4 is associated with respective advancing means 5 along the guide 3.

For example, the advancing means 5 can comprise a gear motor unit 5*a* carrying, on its output axis, a gear wheel engaging with a rack 5*b* associated with the guide 3.

In other embodiments, the advancing means 5 can be constructively different, but functionally equivalent.

The machine 1 also comprises a plurality of expanding shafts 6.

The expanding shafts 6 can be associated with the carriage 4 according to the ways described better hereinafter.

The expanding shafts 6 are arranged along the expanding axis A of the machine 1, i.e. they are parallel to each other.

According to an aspect of the present invention, the machine 1 comprises automatic selection means 7 of the expanding shafts 6.

As better described hereinafter, the automatic selection means 7 are adapted to selectively position the expanding shafts 6 on the carriage 4, so that they remain constrained thereto to execute a certain expansion job.

Thanks to this solution, the machine 1 is autonomously capable, without the manual intervention of an operator, of selecting, i.e. of activating or making operative, the shafts 6 necessary to carry out a certain job, i.e. necessary to expand the tubes provided in a given product; at the same time, the shafts 6 not necessary in that given job are automatically deactivated, i.e. they are not made operative.

This innovative solution will be described in greater detail hereinafter.

As stated, the machine 1 according to the present embodiment is, as a non-limiting example, of the type adapted for carrying out the expansion by traction of the tubes present in a given product to be machined P.

The term product to be machined P is meant to indicate, generically and in a non-limiting manner, a mechanical assembly or component comprising a certain number of straight tubes to be expanded radially.

Such a mechanical assembly or component can for example consist of a heat exchanger with tubes assembled inside a finned pack.

Alternatively, the product P could consist of a mechanical assembly or component of another type, without any limitation.

Figure 2:
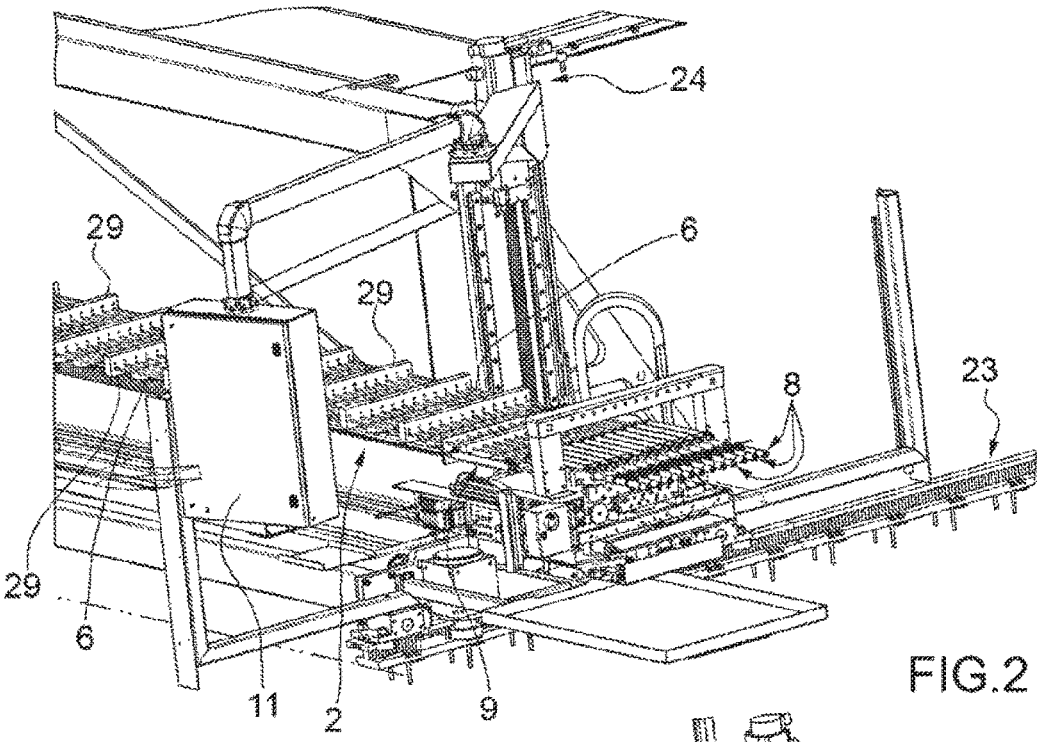
FIG. 2 is a detailed perspective view of the front area of the machine.
Figure 3:
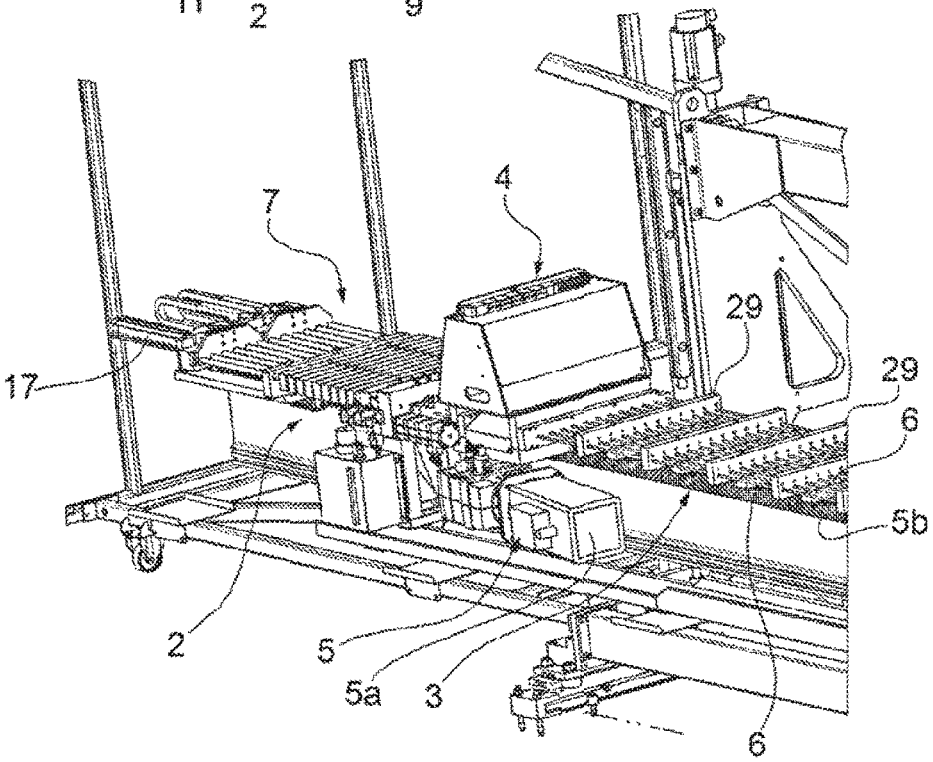
FIG. 3 is a detailed perspective view of the rear area of the machine.
Figure 4:
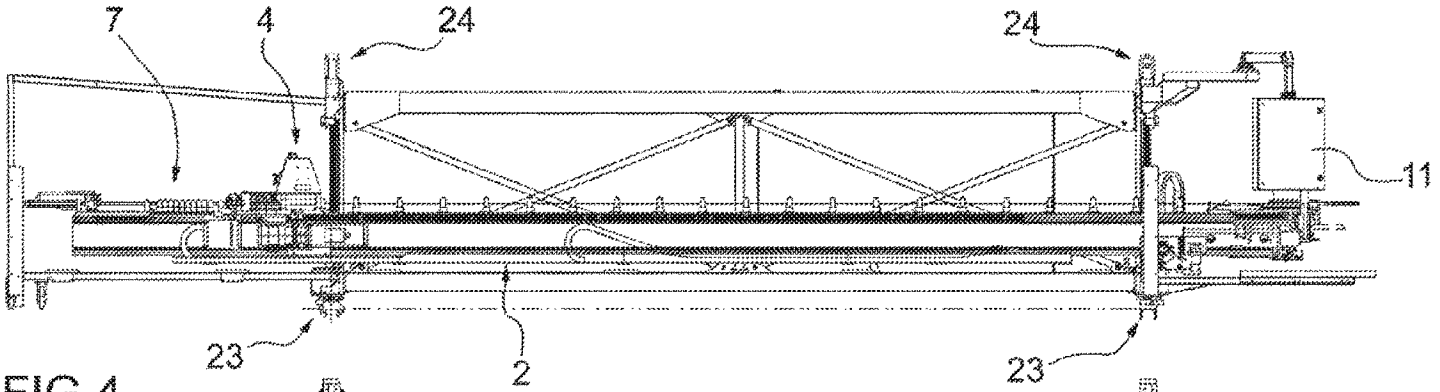
FIG. 4 is a side view of the machine.
Figure 7:
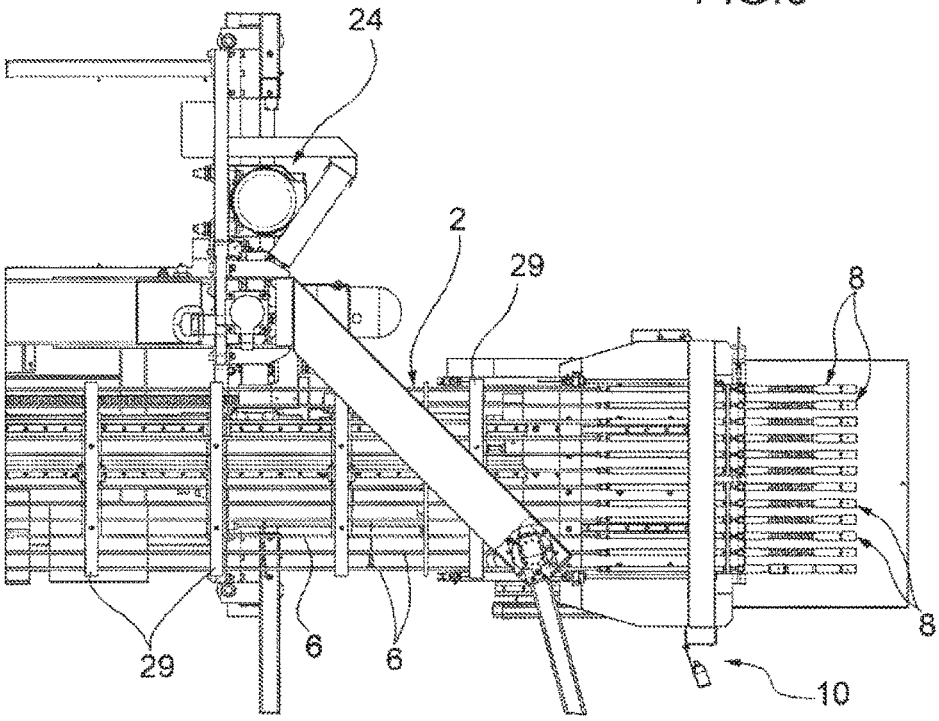
FIG. 7 is a detailed plan view of the front area of the machine.

In order to be able to carry out the expansion of the tubes involved, which in the specific example illustrated is an expansion carried out by traction, the machine 1 comprises a plurality of front contrast means 8 for the respective ends of the tubes, see for example FIGS. 2, 7.

The front contrast means 8 are associated with respective automatic activation/deactivation means 9.

Figure 8:
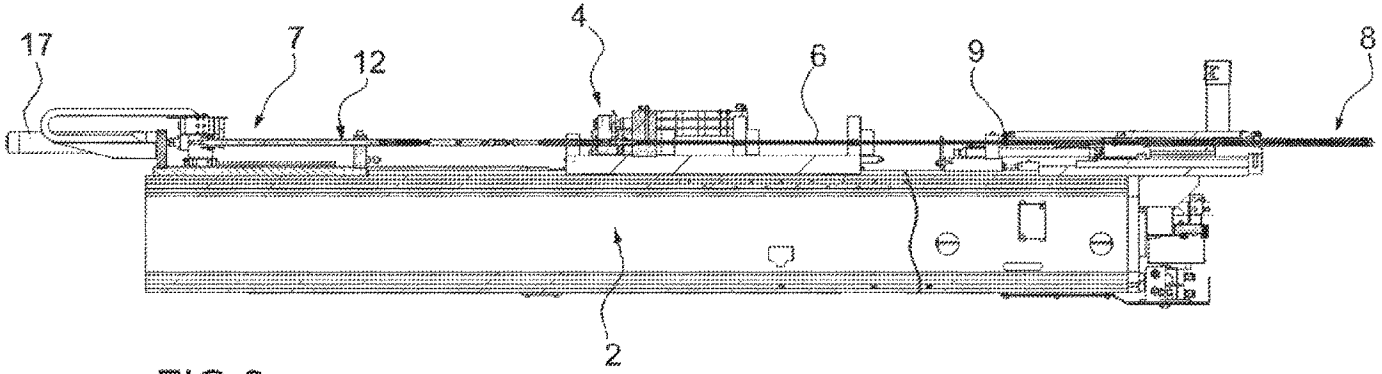
FIG. 8 is a partially sectioned side view of the machine, in a certain operative configuration.
Figure 9:
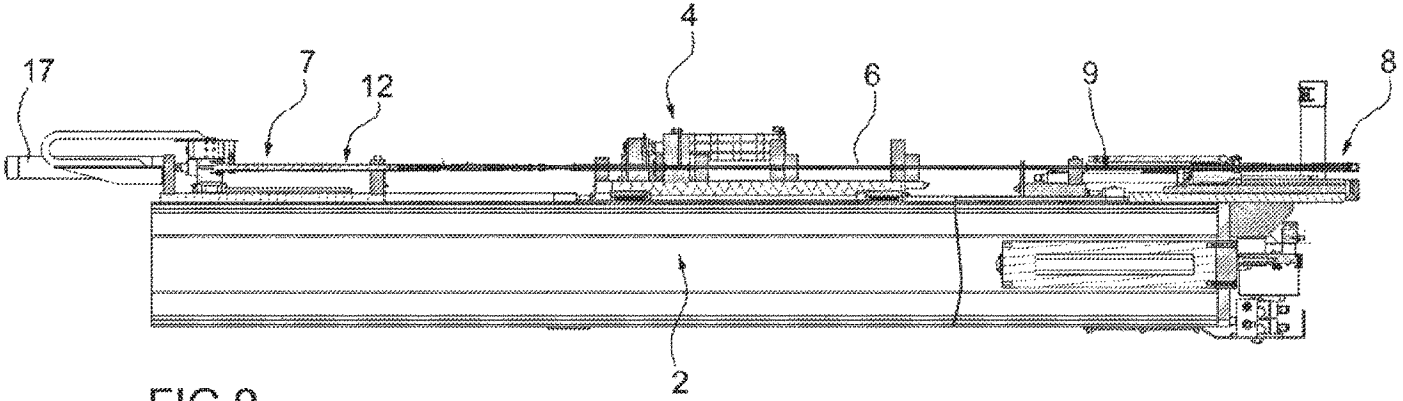
FIG. 9 is another partially sectioned side view of the machine, in another operative configuration.
Figure 10:
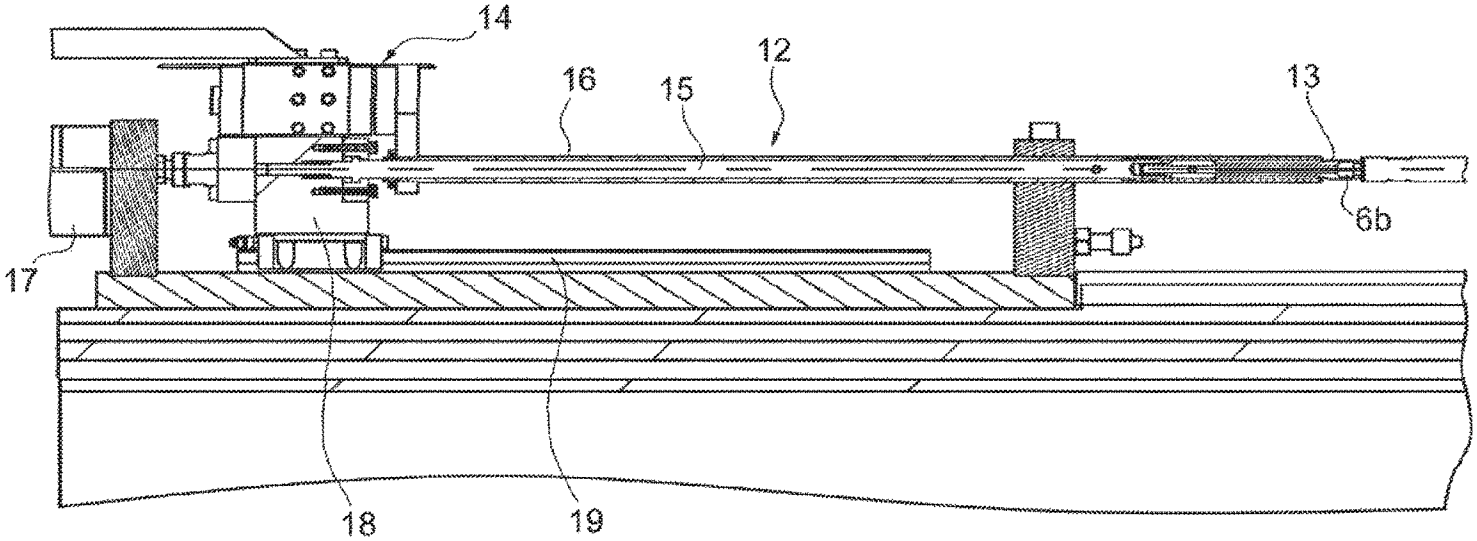
FIG. 10 is a detail of FIG. 8.
Figure 11:
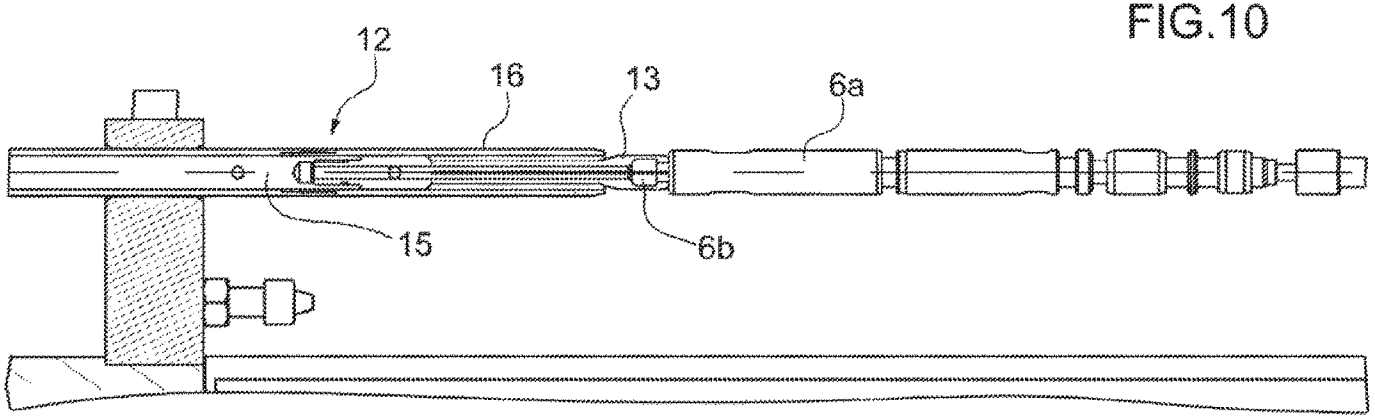
FIG. 11 is a detail of FIG. 10.
Figure 12:
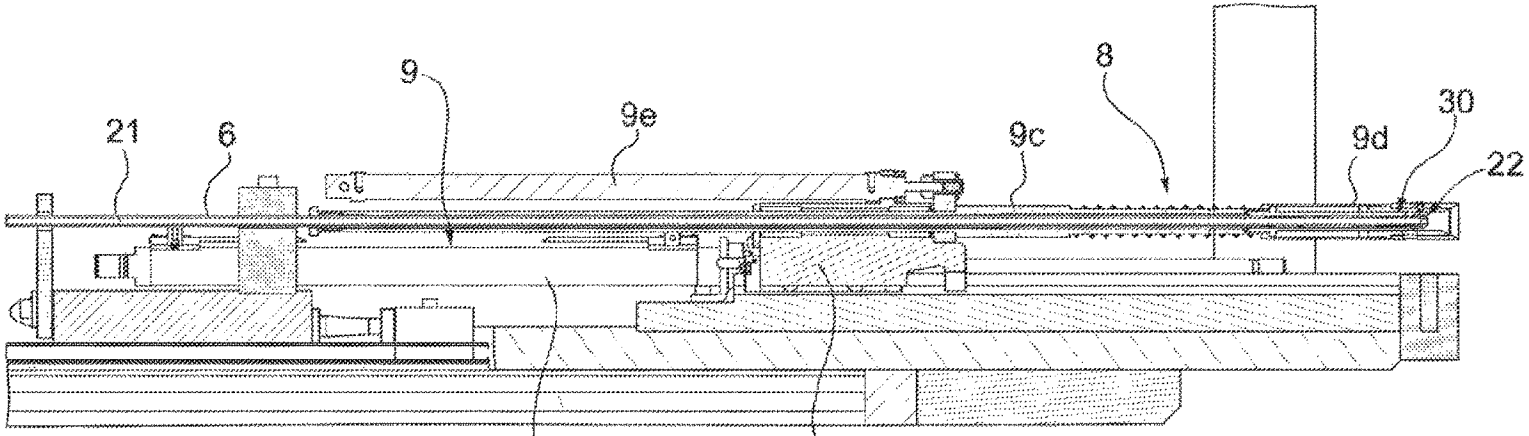
FIG. 12 is a detail of FIG. 9.
Figure 13:
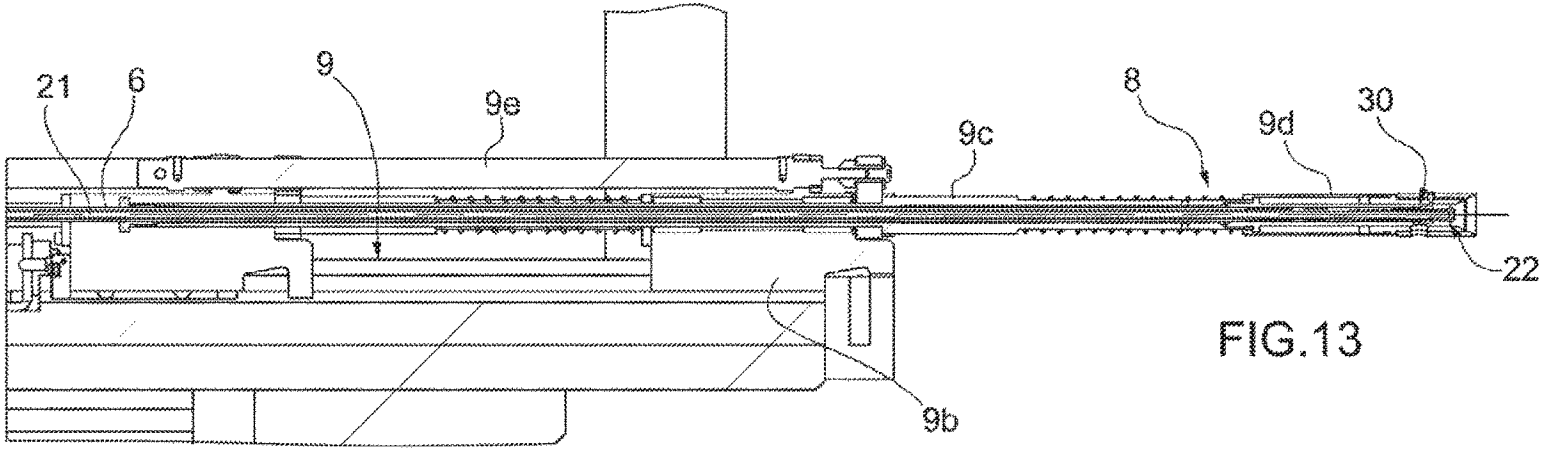
FIG. 13 is another detail of FIG. 8.

The automatic activation/deactivation means 9 are adapted to selectively position the front contrast means 8 in an operative position, illustrated for example in FIGS. 8, 13, or in an inactive position, illustrated for example in FIGS. 9, 12.

The automatic activation/deactivation means 9 can comprise one or more pneumatic cylinders 9*a* with stems associated with a mobile support 9*b*.

The mobile support 9*b* is in turn associated with a plurality of sleeves 9*c* through which the respective expanding shafts 6 pass.

The sleeves 9*c* are elastically associated with respective end tubular elements 9*d* adapted for abutting on the openings of the tubes to be expanded, ensuring the permanent contact that ensures the correct insertion of the shafts 6 in the tubes themselves.

The sleeves 9*c* also comprise respective pneumatic cylinders 9*e* that have the function of bringing the end tubular elements 9*d* close to the tubes in the initial insertion step of the shafts 6.

During expansion, the front contrast means 8 provide the necessary reaction to the traction force exerted by the carriage 4.

According to another aspect of the present invention, the machine 1 comprises automatic recognition means 10 of the geometric characteristics of the product to be machined P.

According to yet another aspect of the present invention, the machine 1 comprises a control unit 11 to which the automatic selection means 6 are operatively connected.

In particular, the control unit 11 is adapted for controlling the automatic selection means 6 in relation to the information acquired through the automatic recognition means 10, concerning the geometric characteristics of the product to be machined P.

The automatic recognition means 10, in an embodiment of the invention, comprise at least one video camera 10*a*.

The video camera 10*a* is able to detect the diameter of the tubes, their arrangement, the distances between centres and other useful information for defining the geometric characteristics of the product to be machined P.

Figure 16:
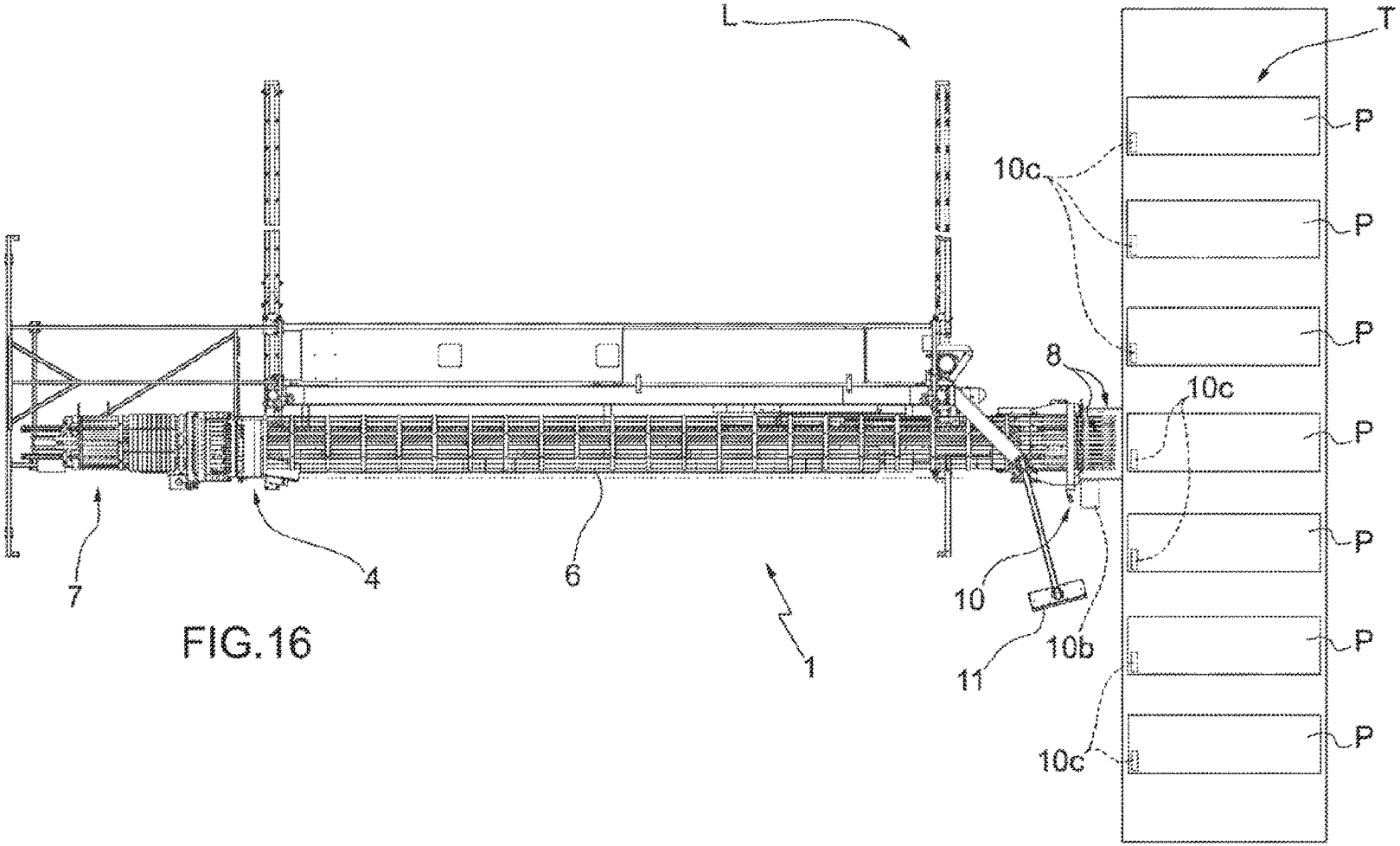
FIG. 16 is a plan view of the machine according to the invention, associated with an automatic conveyor of the products to be machined.

In other embodiments of the invention, and/or in addition to the aforementioned video camera 10*a*—see for example FIG. 16—the automatic recognition means 10 can comprise at least one reader 10*b* of a readable element 10*c* associated with the product being machined P.

The readable element 10*c* can for example consist of a barcode, an RFID circuit, or similar.

The reader 10*b* is consequently selected in relation to the type of readable element 10*c*.

The readable element 10*c* contains information regarding the geometric characteristics of the specific product being machined P.

Such information can be processed by the control unit 11 so as to consequently control the automatic selection means 7, so as to provide the carriage 4 with the necessary expanding shafts 6 to carry out the specific job required.

According to a further aspect of the invention, the automatic selection means 7 comprise a plurality of gripping elements 12.

Each of the gripping elements 12 can be selectively coupled with a respective expanding shaft 6.

Each of the gripping elements 12 is mobile between an inactive position of the respective expanding shaft 6 and a coupling position of the respective expanding shaft 6 with the carriage 4.

In greater detail, in a preferred embodiment of the invention, the gripping elements 12 are mobile along the axes of the respective expanding shafts 6.

Each of said gripping elements 12 comprises a gripper 13.

The aforementioned gripper 13 is adapted to selectively clamp the end head 6*b* of the end 6*a* of the respective expanding shaft 6.

Each of the gripping elements 12 is associated with respective pneumatic actuation means 14.

The pneumatic actuation means 14 are adapted, in particular, to control each gripper 13 from a closed position, in which it clamps the end 6*a* of the expanding shaft 6, to an open position.

In greater detail, the pneumatic actuation means 14 comprise a plurality of pneumatic cylinders, each of which is suitable for selectively bringing the respective gripper 13 from the closed position to the open position and vice-versa. In an embodiment of the invention of particular practical interest—see FIGS. 10, 11—each gripping element 12 comprises an inner stem 15 and an outer tubular element 16; the pneumatic actuation means 14 are in particular associated with the stem 15.

By making the stem 15 slide with respect to the tubular element 16 in one direction or the other, the prongs of the respective gripper 13 are correspondingly closed or opened.

In other embodiments of the invention, the pneumatic actuation means 14 could be associated with the outer tubular element 16, obtaining a functionally equivalent solution.

Figure 6:
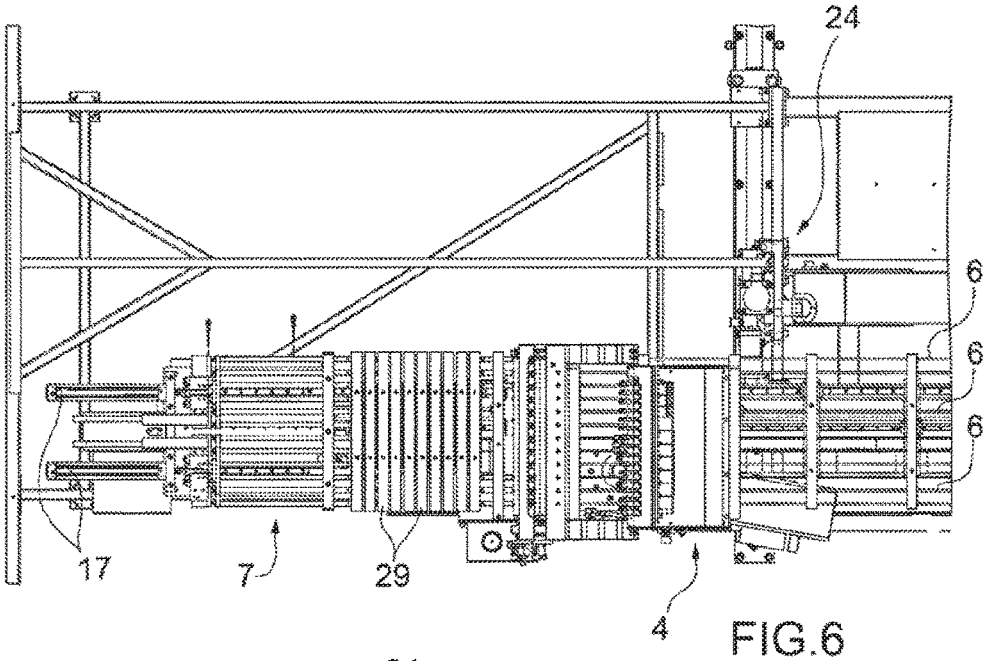
FIG. 6 is a detailed plan view of the rear area of the machine.

According to yet another aspect of the invention, the automatic selection means 7 comprise translation means 17 of the gripping elements 12 between the aforementioned inactive position and the aforementioned coupling position, see for example FIG. 6.

In greater detail, the translation means 17 comprise one or more pneumatic cylinders, having the stem associated with a mobile frame 18 associated with guide means 19 fixedly connected to the frame 2 and parallel to the expanding axis A.

The gripping elements 12 are connected to the mobile frame 18.

According to a further aspect of the invention, the automatic selection means 7 of the expanding shafts 6 comprise a plurality of locking elements 20*a*, 20*b* provided on the carriage 4.

The locking elements 20*a*, 20*b* are particularly adapted to selectively constrain/release the respective expanding shafts 6 to/from the carriage 4.

In greater detail, in the present embodiment of the invention, first locking means 20*a* are provided that are adapted to selectively constrain/release the expanding shafts 6 carrying the expanders 30 to/from the carriage 4, see FIG. 12; second locking elements 20*b* are also provided that are adapted to selectively constrain/release the control rods 21 of the conical pawls 22, which with their translation allow the aforementioned expanders 30 to be expanded or brought back into inactive position.

Each control rod 21 is inserted coaxially inside the respective expanding shaft 6, and its controlled sliding, inside the shaft 6 itself, in one direction or the other, determines the expansion or contraction of the respective expander 30.

The first and the second locking elements 20*a*, 20*b* can comprise respective first and second latches able to be selectively inserted in respective perimeter throats provided in the respective expanding shafts 6 and control rods 21.

In some embodiments of the invention of particular practical interest, the first and second locking elements 20*a*, 20*b* can be associated with respective actuation members, for example of the pneumatic, hydraulic or electric type, which automatically determine the selective opening or closing thereof.

The selective opening or closing of the first and second locking elements 20*a*, 20*b* can be advantageously carried out in a coordinated manner with the actuation of the gripping elements 12, as described better hereafter, thus obtaining a total automation of the selection operations of the expanding shafts 6 to be used for a given product to be machined P.

The support frame 2 of the machine is associated with first translation members 23 and with second translation members 24, fixedly connected to the floor, which determine the movement thereof according to two respective axes B, C perpendicular to each other, and in turn perpendicular to the expanding axis A. A further axis D, parallel to the expanding axis A, allows the support frame 2 to translate, carrying all of the units of the machine 1 with it, towards the product P to be machined, which can, for example, consist of a battery of tubes to be expanded.

If such a battery is very long, the respective tubes are longer than those of a short battery.

The axis D thus has the function of taking the front contrast means 8 into the correct work position based on the length of the tubes to be expanded; moreover, the axis D also has the function of taking the front contrast means 8 away from the product P to allow the translation of the support frame 2 along the axis B. In this way, the expanding shafts 6 can be moved precisely to the desired height at the specific series of tubes to be expanded, in one same product P or even in sequence on different products.

The carriage 4 comprises, in detail, respective through holes 25 along which the expanding shafts 6 are slotted.

Figure 14:
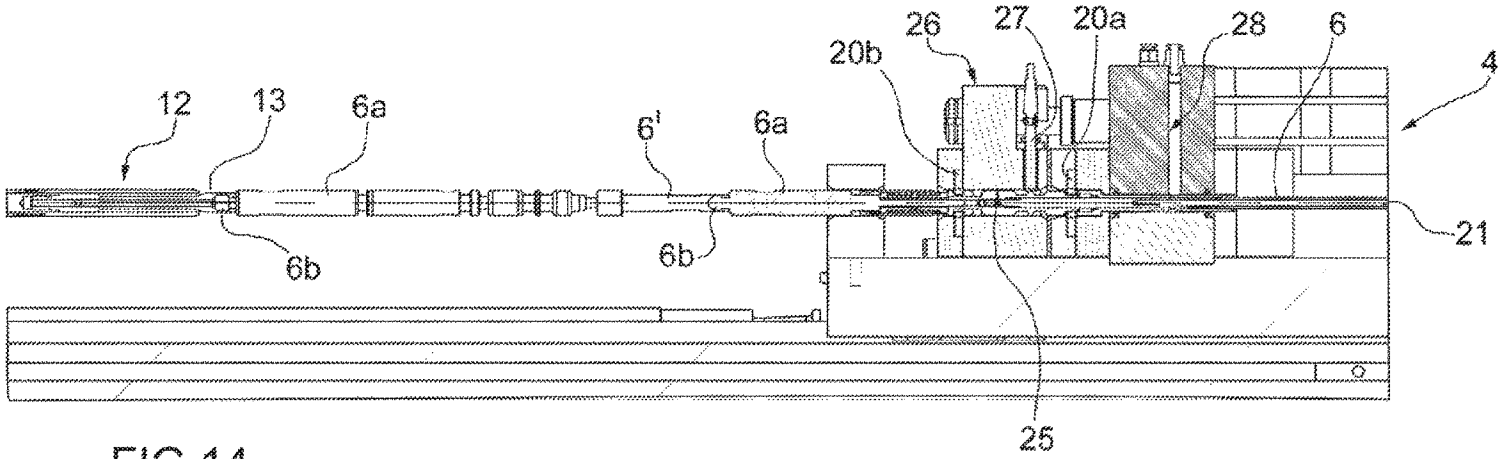
FIG. 14 is yet another detail of FIG. 8.
Figure 15:
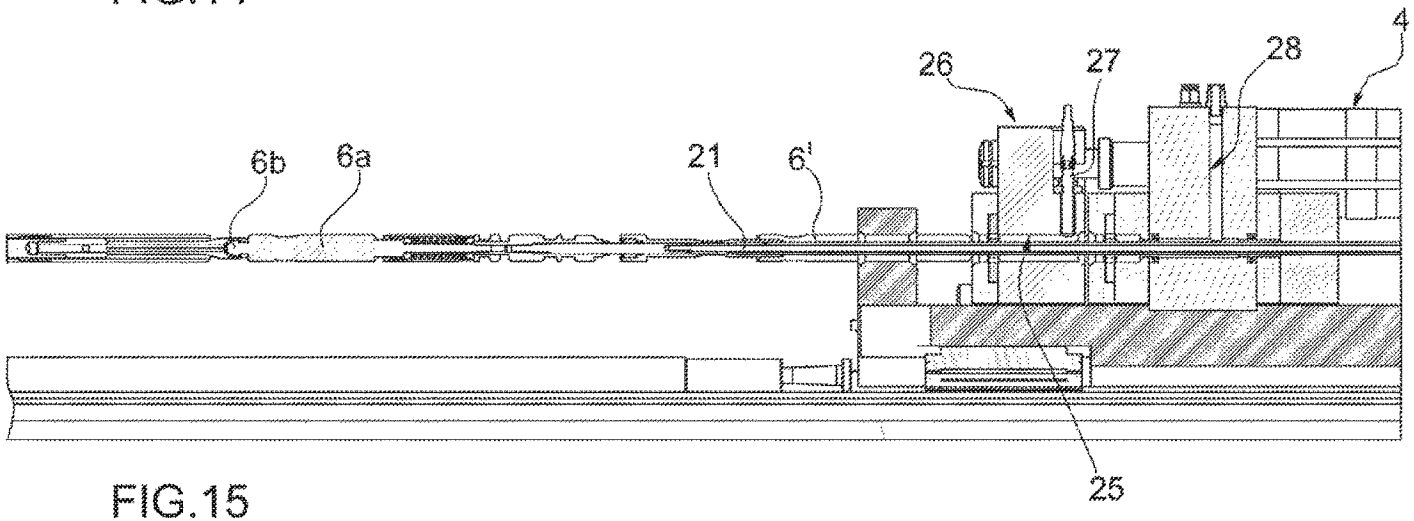
FIG. 15 is another detail of FIG. 9.

With reference for example to FIGS. 14, 15, the carriage 4 also comprises actuation members 26 of the control rods 21, to expand/contract the respective expanders 30 through the conical pawls 22; for example, the actuation members 26 can be of the pneumatic type.

The actuation members 26 comprise, for each of the shafts 6, a control sensor 27 that indeed determines the movement of the control rod 21 inside the respective shaft 6.

The carriage 4 also comprises lubrication means that, through holes 28, take care of sending oil inside each expanding shaft 6, so that such oil reaches the cavity of the respective tube being machined to facilitate the radial expansion operation.

The frame 2 of the machine comprises a plurality of sliding section-breaker elements 29 that support the expanding shafts 6 for their entire length.

The operation of the machine 1 according to the invention is as follows.

The geometric characteristics of the product to be machined P are acquired by the control unit 11 through the automatic recognition means 10, or alternatively they can be set manually by the operator through a suitable interface.

Once the characteristics of the product to be machined P have been acquired, the control unit 11 of the machine 1 controls the automatic selection means 7 so as to activate—i.e. so as to associate with the carriage 4—the expanding shafts 6 actually involved in the machining of that given product P.

In particular, an ideal initial condition, with the machine 1 stopped, is hypothesised, in which all of the expanding shafts 6 are in active position.

In such a condition, all of the first and second locking elements 20*a*, 20*b* hold the respective shafts 6 and control rods 21 fixedly connected to the carriage 4.

If, in relation to the information acquired on the product to be machined P, it becomes necessary to deactivate some of the expanding shafts 6, since the corresponding tubes do not need to be expanded, the automatic selection means 7 firstly actuate the translation means 17, so as to bring all of the gripping elements 12 to the ends 6*a* of the respective shafts 6.

In particular, in this condition the end heads 6*b* of the ends 6*a* are positioned between the prongs of the respective grippers 13.

In relation to the specific shafts 6 to be deactivated, the automatic selection means 7 actuate the gripping elements 12 involved, and in particular the respective pneumatic actuation means 14, so as to clamp the prongs of the respective grippers 13 on the end heads 6*b*.

At the same time, the automatic selection means 7 control the first and second locking elements 20*a*, 20*b* to open.

Alternatively, the opening operation of the first and second locking elements 20*a*, 20*b* can also be carried out manually by the operator. In this way, the expanding shafts 6 to be deactivated can be released from the carriage 4.

At this point, the translation means 17 are actuated in reverse, so as to pull the expanding shafts 6 involved into the inactive position.

In particular, FIG. 14 illustrates a detailed section of the machine 1 with a shaft 6 in active position, and another shaft 6' in inactive position.

FIG. 15, on the other hand, illustrates a detailed section in which only a shaft 6' is shown in inactive position, i.e. withdrawn from the carriage 4.

Having selected and removed, in the described way, the shafts 6' that do not need to be used for a given product to be machined P, the first and second locking elements 20*a*, 20*b* are brought into closed position, so as to constrain the shafts 6 that must be used in the machining once again.

The expansion step of the tubes of the product P can, at this point, be started: the axis D brings the front contrast means 8, activated, towards the tubes to be expanded; the carriage 4 is made to advance, and simultaneously the front contrast means 8 are brought into contact with the ends of the tubes of the product P.

The shafts 6, driven by the carriage 4 and guided by the contrast means 8, therefore penetrate inside the respective tubes, and cross them for their entire length, to be able to expand the tubes at all of the fins involved (for example in the specific case in which the product P to be machined consists of a heat exchanger).

The actuation members 26 are then controlled, and the expanders 30 go into the respective expanded positions.

Thereafter, the carriage 4 is actuated to translate back, so that the expanders 30, crossing the tubes once again for their entire length, determine the radial expansion thereof up to the desired diameter.

At the end of the operation, if it is necessary to once again modify the equipment of the carriage 4 to machine a product P with different characteristics, or a different series of tubes of the same product P with different characteristics, the steps described above are repeated again, this time involving—possibly—different shafts 6 from the previous ones.

Thanks to the technical solution object of the present invention, the machine 1 can autonomously change the machining format extremely quickly and moreover without the intervention of any operator.

This makes it possible to drastically reduce the idle times that, using known machines, must necessarily be dedicated to the manual selection of the shafts involved in the machining, and to the removal, again manual, of those not involved in the same machining.

Consequently, the machine 1 according to the invention has much better characteristics of flexibility and versatility with respect to known apparatuses, since it can also be effectively used in production situations in which different types of products must be machined in a limited number of items, without having unacceptable waiting times such as to make the use of the machine itself disadvantageous.

Another important technical advantage able to be obtained with the machine 1 according to the present invention is the possibility of machining even many products at the same time, i.e. in parallel.

Indeed, the technical solution proposed makes it possible to define, on the same carriage 4, many groups of shafts 6 that actually constitute independent modules, each able to be modified autonomously, in terms of format.

For example, two or three products P with different geometric characteristics, for example comprising a different number of tubes even having a different diameter and with different arrangements in space, can be machined simultaneously.

The technical solution adopted is constructively simple and cost-effective, and it can also be applied to machines 1 that already exist and are already installed.

Another object of the present invention is an automatic expansion line L, illustrated in particular in FIG. 16.

The line L comprises at least one expanding machine 1 having the characteristics described above.

Moreover, the line L comprises at least one automatic conveyor T, or transfer, of the products to be machined P.

The automatic conveyor T is adapted, in particular, to position the products to be machined P in sequence in front of the machine 1, so as to be able to be recognised by the automatic recognition means 10.

The machine 1 can consequently equip, in a completely automatic manner, the carriage 4 to carry out the desired machining.

At the end of the machining, the automatic conveyor T positions another product P in front of the machine 1, and the latter consequently takes care of equipping the carriage 4.

It is clear that there is a reduction in production time with respect to known apparatuses, since the speed of execution of the expanding machine 1 can be fully exploited.

It should be emphasised once again that, although the embodiment of the invention described refers to a machine that specifically carries out the expansion by traction of the tubes of products P, the technical teachings of the present invention are also completely applicable to machines that carry out expansion by thrusting of the tubes.

Indeed, it is sufficient to equip the machine with units specifically prepared for such a type of expansion—for example by mounting means for holding the ends of the tubes, suitable for counteracting the axial thrusting action of the shafts, instead of the front contrast means—to fully obtain the same technical effects and production advantages ensured by the present invention.

It has thus been seen how the invention achieves the proposed purposes.

The present invention has been described according to preferred embodiments, but equivalent variants can be devised without departing from the scope of protection offered by the following claims.

The invention claimed is:

1. A horizontal expanding machine, comprising a support frame defining a horizontal expanding axis (A), at least one guide associated with said frame and parallel to said expanding axis (A), at least one carriage movable along said guide, a plurality of expanding shafts associated with said carriage and arranged along said expanding axis (A), further comprising an automatic selection means of the expanding shafts able to selectively position said shafts on said carriage, wherein said automatic selection means comprise a plurality of gripping elements, each of which is selectively connectable to a respective expanding shaft, wherein each one of said gripping elements is movable between an inactive position of the respective expanding shaft and a coupling position of the respective expanding shaft to said carriage, and wherein said gripping elements are movable along the axes of the respective expanding shafts.

2. The machine according to claim 1, comprising automatic recognition means of geometrical characteristics of the product to be machined (P).

3. The machine according to claim 2, comprising at least one control unit to which said automatic selection means are operatively connected, able to control said automatic selection means in relation to information acquired through said automatic recognition means.

4. The machine according to claim 2, wherein said automatic recognition means comprise at least one video camera.

5. The machine according to claim 2, wherein said automatic recognition means comprise at least one reader of a readable element associated with the product being machined (P).

6. The machine according to claim 1, wherein each one of said gripping elements comprises a gripper able to selectively clamp the end of the respective expanding shaft.

7. The machine according to claim 6, wherein each one of said gripping elements is associated with pneumatic actuation means.

8. The machine according to claim 7, wherein said pneumatic actuation means comprise a plurality of pneumatic cylinders each of which is able to selectively open and/or close said gripper.

9. The machine according to claim 1, wherein said automatic selection means comprise translation means of said gripping elements between said inactive position to said coupling position.

10. The machine according to claim 1, wherein said automatic selection means comprise a plurality of locking elements provided on said carriage, able to selectively fasten and/or release a respective expanding shaft to said carriage.

11. The machine according to claim 10, wherein said locking elements comprise latches selectively insertable in respective perimeter throats provided in each respective expanding shaft.

12. The machine according to claim 1, for performing traction expanding of a plurality of tubes, comprising a plurality of front contrast means for respective ends of said tubes, said front contrast means being associated with respective automatic activation and/or deactivation means.

13. An automatic expansion line, comprising at least one expanding machine according to claim 2, and at least one automatic conveyor (T) of the products to be machined (P), said automatic conveyor (T) being able to place the products in sequence (P) in front of said machine so as to be recognized by said automatic recognition means.

* * * * *